United States Patent [19]

Hazard

[11] Patent Number: 4,660,781

[45] Date of Patent: Apr. 28, 1987

[54] ROLL TISSUE DISPENSER

[75] Inventor: James E. Hazard, Swarthmore, Pa.

[73] Assignee: Scott Paper Company, Philadelphia, Pa.

[21] Appl. No.: 683,893

[22] Filed: Dec. 20, 1984

[51] Int. Cl.[4] ..... B65H 16/00; B65H 23/06

[52] U.S. Cl. ..... 242/55.2; 242/75.46

[58] Field of Search ..... 242/54, 134, 55.2, 55.3, 242/55.53, 129.8, 207, 75.4, 75.46, 72 R, 73, 156; 225/34, 46, 47; 226/151

[56] References Cited

U.S. PATENT DOCUMENTS

| | | | |
|---|---|---|---|
| 909,456 | 1/1909 | Rich | 242/134 |
| 2,198,421 | 4/1940 | Wise | 242/72 |
| 2,699,903 | 1/1955 | Montgomery | 242/55.2 |
| 2,859,919 | 11/1958 | DeBrie | 242/75.46 X |
| 3,281,089 | 10/1966 | Krueger et al. | 242/129.8 X |
| 3,770,221 | 11/1973 | Stern | 242/55.2 |
| 4,447,015 | 5/1984 | Peterson | 242/55.2 |

FOREIGN PATENT DOCUMENTS

| | | | |
|---|---|---|---|
| 1111658 | 5/1968' | United Kingdom | 242/75.46 |

*Primary Examiner*—John M. Jillions

*Attorney, Agent, or Firm*—Joseph H. Yamaoka; John W. Kane, Jr.

[57] ABSTRACT

A dispenser for a roll (10) of sanitary paper wound on a hollow core (12). The dispsenser (10) has a core supporting member (16) that contacts the inner surface (13) of the core (12) and has a braking surface (20). The coefficient of friction between the member (16) supporting the roll (10) and the inner surface (13) of the core (12) is less than the coefficient of friction between the braking surface (20) and the inner surface (13) of the core (12). The dispenser (10) also includes a compliant member (18), such as a spring, connected to the core supporting member (16). The compliant member (18) is responsive to the weight of the roll (10) and urges the inner surface (13) of the core (12) toward the braking surface (20). At some point during the dispensing of the roll (10), the frictional force, or drag, developed between the inner surface (13) of the core (12) and the braking surface (20) increases as the weight of the roll (10) decreases.

4 Claims, 5 Drawing Figures

ROLL TISSUE DISPENSER

TECHNICAL FIELD

This invention relates to dispensers for roll sanitary paper products. More particularly, this invention is related to a dispenser for a sanitary paper product that is wound on a core and in which a frictional force is applied to the inner surface of the core in a variable relation to the weight of the roll.

BACKGROUND ART

Sanitary paper products are typically packaged as a roll of paper wound onto a core. In a typical toilet tissue roll, paper is wound on a core having a diameter of 1.6 inches and wound to a diameter of about 4.5 inches and weighs about 0.5 pounds or less. These toilet tissue rolls are generally dispensed from a mandrel by pulling on a loose end of the paper. If the frictional force developed between the mandrel and the inner surface of the core is small, pulling on the loose end of the roll during dispensing can cause the roll to overspin thereby dispensing more paper than is necessary. The prior art approach for solving this problem has been to provide an additional frictional member between the mandrel and the inner surface of the core. In U.S. Pat. No. 2,699,903—Montgomery, an adaptor 1 has resilient fins 2 which frictionally engage the inner surface of core C to prevent overspinning of the roll. Another U.S. Patent, U.S. Pat. No. 4,447,015—Petersen discloses a toilet tissue dispenser in which the mandrel 20 has four ribs 40 which frictionally engage the inner surface of the core to prevent overspinning of the roll. In U.S. Pat. No. 3,770,221—Stern, the embodiment of FIG. 1 discloses a dispenser in which four spring fingers 28 spaced 90° apart are secured to a mandrel and frictionally engage the inner surface of the core. It is believed that all of the above-described prior art dispensers are designed to develop, for a given roll, a constant frictional drag force against the inner surface of the core as the roll is consumed.

In certain applications it may be desirable to use a relatively large diameter roll of paper product. For example, a roll of toilet tissue wound on a core having a diameter of 3 inches and wound to have an overall roll diameter of 14 inches could have an initial weight to about 5 pounds. When such a roll is placed on a mandrel, a relatively large frictional force is developed between the inner surface of the core and the surface of the mandrel. To overcome this frictional force, a relatively large force must be applied to the end of the paper on the roll. If the frictional forces are large enough, the force applied to the end of the paper may cause the sheet to tear before the roll rotates sufficiently to dispense a useful length of the tissue paper. When the roll diameter becomes small because the roll is consumed, the frictional drag on the inner surface of the core is very low and the roll is subject to overspinning as encountered with the prior art small consumer rolls. It can be seen from the above description of the problem that what is desired is to have a relatively low frictional force acting against the inner surface of the core initially and a relatively higher frictional force resisting rotation of the roll as the diameter of the roll is reduced.

It is, therefore, an object of this invention to provide a dispenser for a rolled sanitary paper product in which the frictional force at an inner surface of the core is increased after the roll has been partially consumed.

It is another object of this invention to provide a dispenser for a rolled sanitary paper product in which at some point during the dispensing of the roll, the frictional force developed at an inner surface of the core increases as the weight of the roll decreases.

DISCLOSURE OF THE INVENTION

In accordance with this invention, there is provided a dispenser for a roll of sanitary paper wound on a hollow core. The dispenser has a core supporting member that contacts the inner surface of the core and has a braking surface. The coefficient of friction between the member supporting the roll and the inner surface of the core is less than the coefficient of friction between the braking surface and the inner surface of the core. The dispenser also includes a compliant member, such as a spring, connected to the core supporting member. The compliant member is responsive to the weight of the roll and urges the inner surface of the core toward the braking surface. At some point during the dispensing of the roll, the frictional force, or drag, developed between the inner surface of the core and the braking surface increases as the weight of the roll decreases.

In one preferred embodiment, when a full roll is mounted on the dispenser, the inner surface of the core is spaced from the braking surface. In the most preferred embodiment, the dispenser comprises a fixed mandrel having a metal leaf spring secured to the top of the mandrel and a braking surface secured to a lower surface of the mandrel. The roll is placed over the spring and the mandrel, the two elements together acting to support the weight of the roll and the surface or surfaces of the spring acting as the member contacting the inner surface of the core. The coefficient of friction between the metal leaf spring and the inner surface of the core is less than the coefficient of friction between the braking surface and the inner surface of the core. The dispenser is designed so that when a full roll is mounted in the dispenser, the spring deflects by an amount that leaves a gap between the inner surface of the core and the braking surface.

BRIEF DESCRIPTION OF THE DRAWINGS

While the specification concludes with claims particularly pointing out and distinctly claiming that which is regarded as the present invention, the objects and advantages of this invention can be more readily ascertained from the following description of a preferred embodiment when read in conjunction with the accompanying drawings in which:

BEST MODE FOR CARRYING OUT THE INVENTION

For the sake of convenience, an element that is depicted in more than one figure will retain the same element number in each figure.

Figure 1:
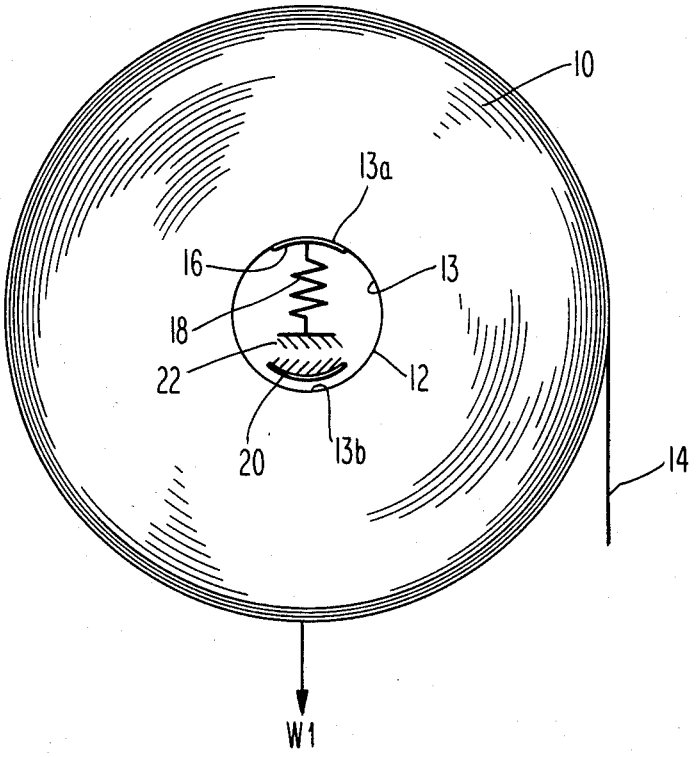
FIG. 1 is a schematic representation of the roll braking dispenser when the roll is full.
Figure 2:
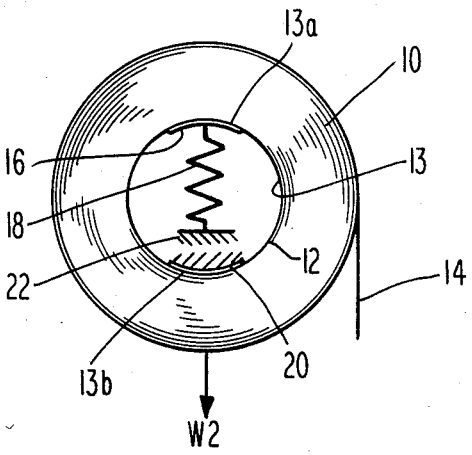
FIG. 2 is a schematic representation of the roll braking dispenser of FIG. 1 when the roll is partially consumed.

As shown in FIGS. 1 and 2, a roll 10 of sanitary paper such as toilet tissue is wound on a hollow core 12. A dispenser for the roll 10 includes a compliant member 18, one end of which as represented by the symbol 22 is fixedly supported and the other end of the compliant member 18 is secured to a core support member 16. The dispenser also includes a braking surface 20 fixedly mounted within the dispenser. The coefficient of friction between the inner surface 13 of the core 12 and the braking surface 20 is greater than the coefficient of friction between the inner surface 13 of the core 12 and the core support member 16. As shown in FIG. 1, when a full roll 10 is placed in the dispenser, the weight of the roll 10 causes compliant member 18 to be compressed so that the bottom inner surface 13*b* of the core 12 does not contact the braking surface 20. As the roll 10 is caused to rotate such as by pulling on an end sheet 14 of the core 10, a frictional force is developed between the upper inner surface 13*a* of the core 12 and the surface of core contacting member 16. As the roll 10 is consumed, the weight of the roll 10 is reduced allowing the compliant member 18 to expand. Eventually, the weight of the roll 10 will be sufficiently reduced and compliant member 18 sufficiently expanded so that the bottom inner surface 13*b* of the core 12 contacts the braking surface 20 as illustrated in FIG. 2. As paper is further dispensed from the roll 10, the frictional force developed between the bottom inner surface 13*b* of the core 12 and the braking surface 20 increases. Thus, the frictional force developed between the bottom inner surface 13*b* of the core 12 has an inverse relationship to the weight of the roll 10.

Although FIG. 1 depicts a dispenser system in which the bottom inner surface 13*b* of the core 12 does not contact the braking surface 20 when a full roll 10 is mounted on the dispenser, it will be apparent to one skilled in the art that FIG. 2 suggests that the elements of the dispenser can be designed so that when the roll 10 is full, the lower inner surface 13*b* of the core 12 can initially contact the braking surface 20.

Figure 4:
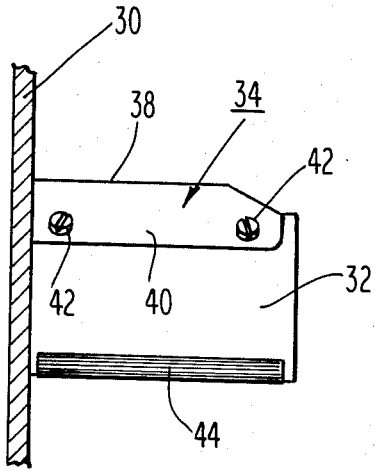
FIG. 4 is a side elevation of FIG. 3.
Figure 3:
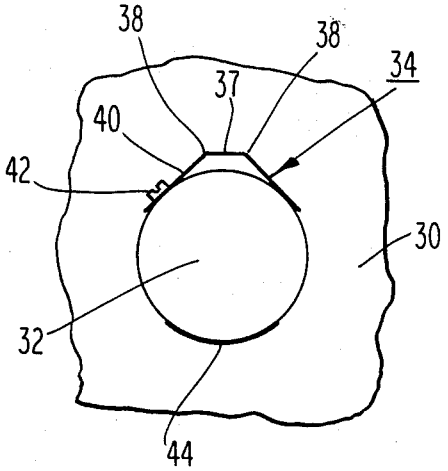
FIG. 3 is a front elevation of a preferred roll braking dispenser.
Figure 5:
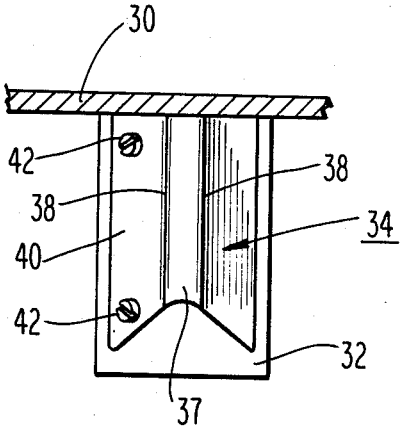
FIG. 5 is a top plan view of FIG. 3.

FIGS. 3–5 illustrate a preferred embodiment of the invention. A roll support mandrel 32 is secured to a wall 32 which could, for example, be the wall of a toilet tissue dispenser which is not illustrated. A compliant leaf spring 34 is bent at lines 38 to form a short horizontal section 37 and two angled leg sections 36 and 40. Leg 40 of leaf spring 34 is secured to the roll support mandrel 32 by means of screws 42. A braking surface 44 is secured by means of adhesive to the bottom surface of mandrel 32.

In operation, a full roll is placed over the mandrel 32 and the spring 34 with the upper inner surface of the core contacting the spring 34 along the lines 38. Because leg 36 of the spring 34 is not secured to the mandrel 32, the weight of the roll causes the spring 34 to deflect by an amount which leaves a gap between the lower inner surface of the core and the braking surface 44. At some point as the roll is consumed, the weight of the roll will be sufficiently reduced so that the spring 34 urges the lower inner surface of the core into contact with the braking surface 44. As the weight of the roll is then further reduced, the frictional force developed between the lower inner surface of the core and the braking surface 44 will increase as the weight of the roll decreases. The coefficient of friction between the metallic leaf spring 34 and the inner surface of the core is selected so that the free end of the roll will not tear prematurely while dispensing a full roll. The coefficient of friction between the inner surface of the core and the braking surface 44 is selected to control the overspinning of the roll at smaller diameters.

While the present invention has been described with reference to a specific embodiment thereof, it would be obvious to those skilled in the art that various changes and modifications may be made without departing from the invention in its broader aspects.

I claim:

1. A dispenser for a roll of sanitary paper having a hollw core, the roll being supported in the dispenser with its core axis oriented horizontally, the dispenser comprising:

(a) a fixed horizontal support member mounted in the dispenser for extension within the core;

(b) a compliant member secured to an upper surface of the support member for contacting an upper inner surface of the core; and (c) a lower surface of the support member providing a braking surface within the core having a higher coefficient of friction with respect to the core than the compliant member, said compliant member being responsive to the weight of the roll so as to urge a lower inner surface of the core into contact with the braking surface whereby the frictional force developed between the braking surface and the core increases as the weight of the roll decreases.

2. A dispenser as recited in claim 1 wherein the braking surface is fixedly mounted in the dispenser beneath the support member.

3. A dispenser as recited in claim 1 wherein the compliant means is a spring.

4. A dispenser as recited in claim 2 wherein the compliant means is a spring.

* * * * *